US006152047A

United States Patent [19]

Mac Namara

[11] Patent Number: 6,152,047

[45] Date of Patent: Nov. 28, 2000

[54] TABLE MOUNTED TRASH RECEPTACLE

[76] Inventor: Sinead M. Mac Namara, 9-15 Glover Ave. #2E, Yonkers, N.Y. 10704

[21] Appl. No.: 09/182,817

[22] Filed: Oct. 29, 1998

[51] Int. Cl.[7] ..... A47B 85/00

[52] U.S. Cl. ..... 108/26; 108/25; 220/830

[58] Field of Search ..... 108/26, 25, 152; 220/830, 826, 908, 910, 911; 49/366, 368, 369

[56] References Cited

U.S. PATENT DOCUMENTS

| | | | |
|---|---|---|---|
| 1,745,769 | 2/1930 | Schroedter | 220/830 X |
| 2,683,639 | 7/1954 | Brenny | 108/26 |
| 2,711,830 | 6/1955 | Howell | 108/26 X |
| 3,083,859 | 4/1963 | Gardiner | 220/826 X |
| 3,364,882 | 1/1968 | Merrick | 108/25 |
| 4,204,369 | 5/1980 | Hubbard | 49/366 X |
| 4,437,714 | 3/1984 | Struck | 108/25 X |
| 4,679,700 | 7/1987 | Tharrington et al. | 20/830 X |
| 5,823,367 | 10/1998 | Moran, Jr. | 108/25 X |

FOREIGN PATENT DOCUMENTS

| | | | |
|---|---|---|---|
| 661624 | 5/1938 | Germany | 108/25 |
| 405064606 | 3/1993 | Japan | 108/25 |
| 691450 | 5/1953 | United Kingdom | 108/26 |
| 2239593 | 7/1991 | United Kingdom | 220/910 |

*Primary Examiner*—Peter M. Cuomo
*Assistant Examiner*—Hanh V. Tran

[57] ABSTRACT

A table mounted trash disposal system is provided including a container attached to a table and depending therefrom such that an open top of the container is generally level with the table. Also included is at least one door pivotally mounted over the open top of the container for being pivoted between a horizontal orientation and downwardly extending orientation. A spring member is provided for urging the door into the horizontal orientation.

3 Claims, 3 Drawing Sheets

TABLE MOUNTED TRASH RECEPTACLE

BACKGROUND OF THE INVENTION

1. Field of the Invention

The present invention relates to trash disposal assemblies and more particularly pertains to a new table mounted trash receptacle for conveniently disposing of condiment wrappers, tissues, napkins, and other litter on a table within a restaurant, lounge or cafeteria.

2. Description of the Prior Art

The use of trash disposal assemblies is known in the prior art. More specifically, trash disposal assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art trash disposal assemblies include U.S. Pat. No. 5,036,998; U.S. Pat. No. 1,579,823; U.S. Pat. No. 4,166,572; U.S. Pat. No. 4,747,352; U.S. Pat. No. 2,633,398; and U.S. Pat. Des. 289,596.

In these respects, the table mounted trash receptacle according to the present invention substantially departs from the conventional concepts and designs of the prior art, and in so doing provides an apparatus primarily developed for the purpose of conveniently disposing of condiment wrappers, tissues, napkins, and other litter on a table within a restaurant, lounge or cafeteria.

SUMMARY OF THE INVENTION

In view of the foregoing disadvantages inherent in the known types of trash disposal assemblies now present in the prior art, the present invention provides a new table mounted trash receptacle construction wherein the same can be utilized for conveniently disposing of condiment wrappers, tissues, napkins, and other litter on a table within a restaurant, lounge or cafeteria.

The general purpose of the present invention, which will be described subsequently in greater detail, is to provide a new table mounted trash receptacle apparatus and method which has many of the advantages of the trash disposal assemblies mentioned heretofore and many novel features that result in a new table mounted trash receptacle which is not anticipated, rendered obvious, suggested, or even implied by any of the prior art trash disposal assemblies, either alone or in any combination thereof.

To attain this, the present invention generally comprises a table having a planar top face and a plurality of legs coupled to corners of the top face and extending downwardly therefrom. As shown in FIG. 1, the table further has a first rectangular cut out formed in the table adjacent to and in parallel with one side edge thereof. Associated therewith is an optional second rectangular cut out formed in the table and positioned in parallel relationship with the first rectangular cut out. Ideally, the second rectangular cut out has a size and a shape similar to that of the first rectangular cut out. It should be noted that each cut out is defined by a pair of elongated side edges and a pair of short end edges. Next provided is a pair of guides each mounted along the elongated side edges of the first rectangular cut out. As shown in FIG. 3, the guides depend from the table during use. Further, each of the guides preferably has an L-shaped configuration along an entire length thereof. FIG. 3 shows a trash container including a planar rectangular bottom face and a side wall integrally coupled to a periphery of the bottom face and extending upwardly therefrom. By this structure, an interior space, an open top, and an upper peripheral edge is defined. The upper peripheral edge has a pair of elongated side edges and a pair of short end edges each having an outwardly extending peripheral lip. This lip serves for being slidably received by the guides to align the open top of the container with the first rectangular cut out. With reference again to FIG. 2, a pair of doors are shown to each have a planar rectangular configuration with a length equal to that of the first rectangular cut out and a width equal to half that of the first rectangular cut out. The doors have tubular sleeves mounted along inboard edges thereof which hingably receive rods extending between the end edges along opposite side edges of the container. As such, each door may be pivoted between a horizontal orientation and a downwardly angled orientation. In the preferred embodiment, each door has an inboard extent constructed from solid plastic and has a width equal to ¾ that of the door. An outboard extent of the door has a plurality of resilient bristles coupled to an outboard edge of the inboard extent of the door and extends therefrom in coplanar relationship therewith. The outboard extent has a width equal to ¼ that of the door. Lastly, a spring is mounted between the tubular sleeve of the door and the container for urging the doors in a horizontal coplanar relationship. As an option, an ice bin may be included having a planar rectangular bottom face and a side wall similar to that of the trash container. The upper peripheral edge of the ice bin is coupled about a periphery of the second cut out and depends below the table. The ice bin has an inwardly extending peripheral lip, as shown in FIG. 7. In use, the ice bin serves for being filled with ice level with the inwardly extending lip. Finally, a removable condiment tray includes a planar rectangular bottom face and a side wall similar to that of the trash container and the ice bin. The removable condiment tray further includes a pair of laterally extending dividers spaced between short end faces of the tray. Each laterally extending divider is equipped with a size and shape equal to that of the end faces of the removable condiment tray. By this structure, the removable condiment tray includes a pair of small end compartments and a large central compartment. In use, the removable condiment tray is adapted for being removably positioned atop the inwardly extending lip of the ice bin for being cooled by the ice. Further, the removably condiment tray is equipped with a height sufficient to maintain the upper peripheral edge of the removable condiment tray level with an upper surface of the table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new table mounted trash receptacle apparatus and method which has many of the advantages of the trash disposal assemblies mentioned heretofore and many novel features that result in a new table mounted trash receptacle which is not anticipated, rendered obvious, suggested, or even implied by any of the prior art trash disposal assemblies, either alone or in any combination thereof.

It is another object of the present invention to provide a new table mounted trash receptacle which may be easily and efficiently manufactured and marketed.

It is a further object of the present invention to provide a new table mounted trash receptacle which is of a durable and reliable construction.

An even further object of the present invention is to provide a new table mounted trash receptacle which is susceptible of a low cost of manufacture with regard to both materials and labor, and which accordingly is then susceptible of low prices of sale to the consuming public, thereby making such table mounted trash receptacle economically available to the buying public.

Still yet another object of the present invention is to provide a new table mounted trash receptacle which provides in the apparatuses and methods of the prior art some of the advantages thereof, while simultaneously overcoming some of the disadvantages normally associated therewith.

Still another object of the present invention is to provide a new table mounted trash receptacle for conveniently disposing of condiment wrappers, tissues, napkins, and other litter on a table within a restaurant, lounge or cafeteria.

Even still another object of the present invention is to provide a new table mounted trash receptacle that includes a container attached to a table and depending therefrom such that an open top of the container is generally level with the table. Also included is at least one door pivotally mounted over the open top of the container for being pivoted between a horizontal orientation and downwardly extending orientation. A spring member is provided for urging the door into the horizontal orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
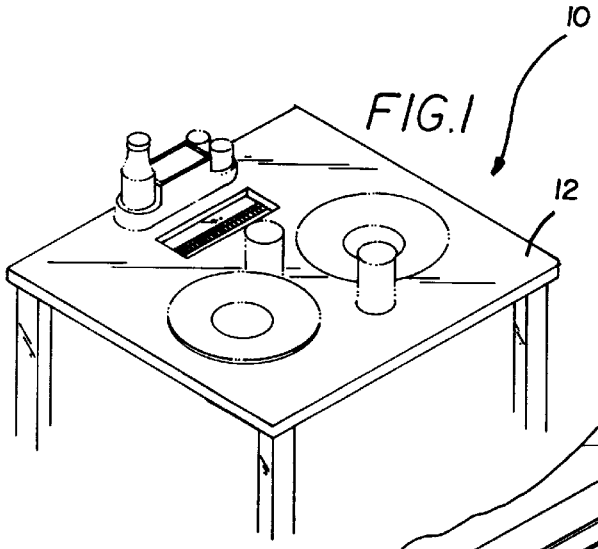
FIG. 1 is a perspective view of a new table mounted trash receptacle according to the present invention.

With reference now to the drawings, and in particular to FIGS. 1 through 7 thereof, a new table mounted trash receptacle embodying the principles and concepts of the present invention and generally designated by the reference numeral 10 will be described.

The present invention, designated as numeral 10, includes a table 12 having a planar top face and a plurality of legs coupled to corners of the top face and extending downwardly therefrom. As shown in FIG. 1, the table further has a first rectangular cut out 14 formed therein adjacent to and in parallel with one side edge thereof. Associated therewith is an optional second rectangular cut out 16 formed in the table and positioned in parallel relationship with the first rectangular cut out. Ideally, the second rectangular cut out has a size and a shape similar to that of the first rectangular cut out. It should be noted that each cut out is defined by a pair of elongated side edges and a pair of short end edges.

Figure 3:
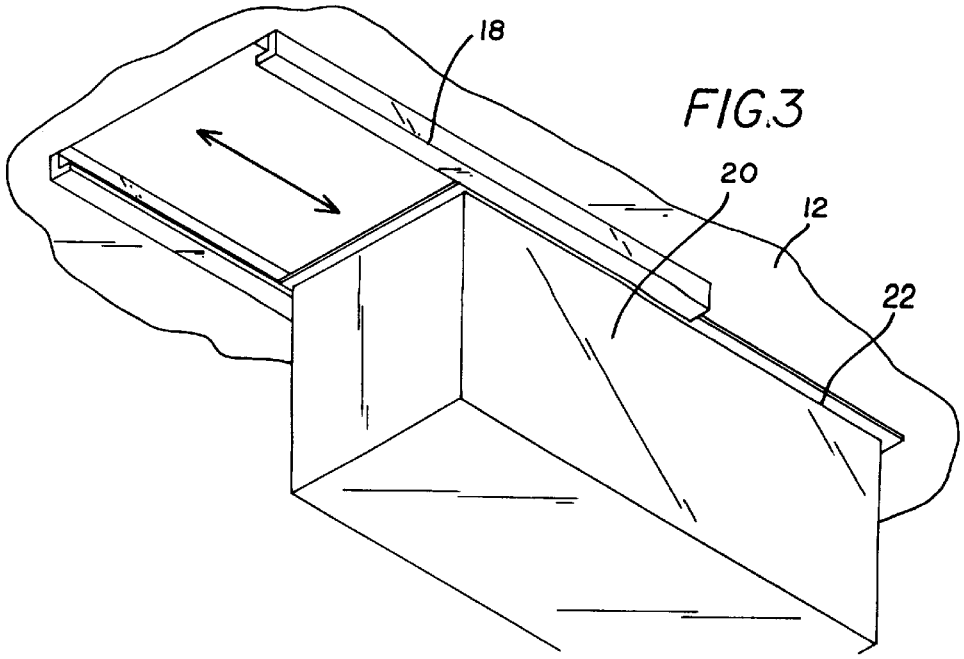
FIG. 3 is a bottom perspective view of the trash container of the present invention.
Figure 4:
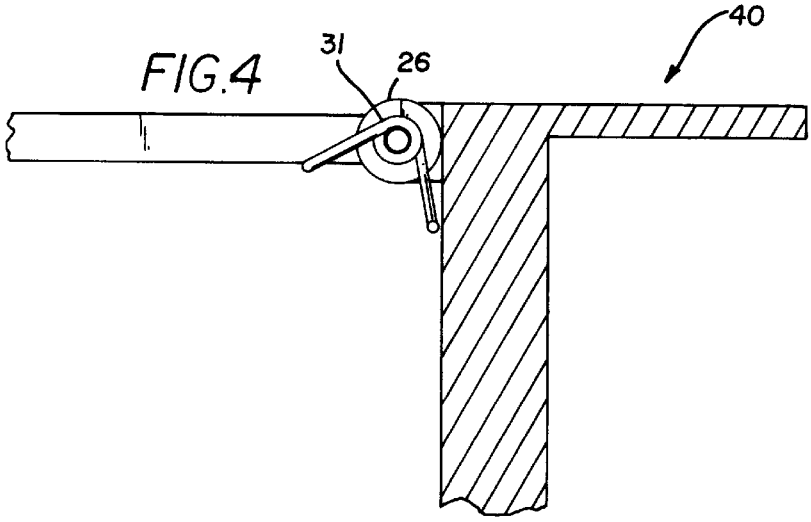
FIG. 4 is a side cross-sectional view of an alternate embodiment of the present invention.
Figure 5:
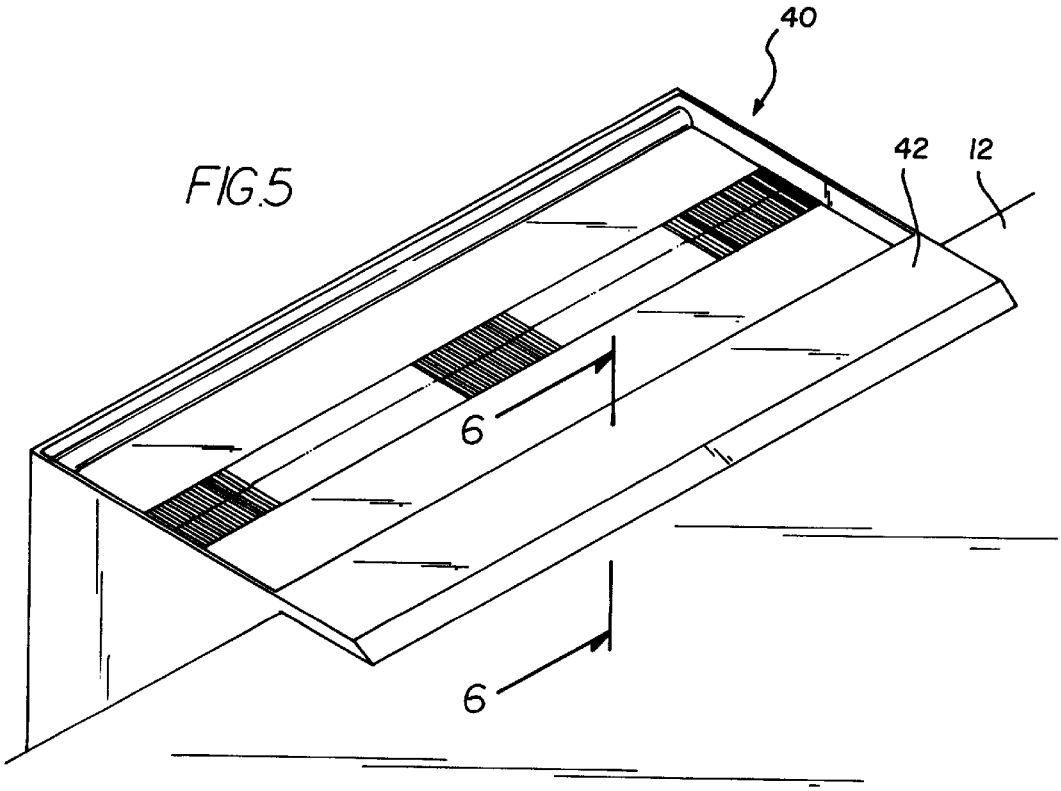
FIG. 5 is a top view of the embodiment of the present invention shown in FIG. 4.
Figure 6:
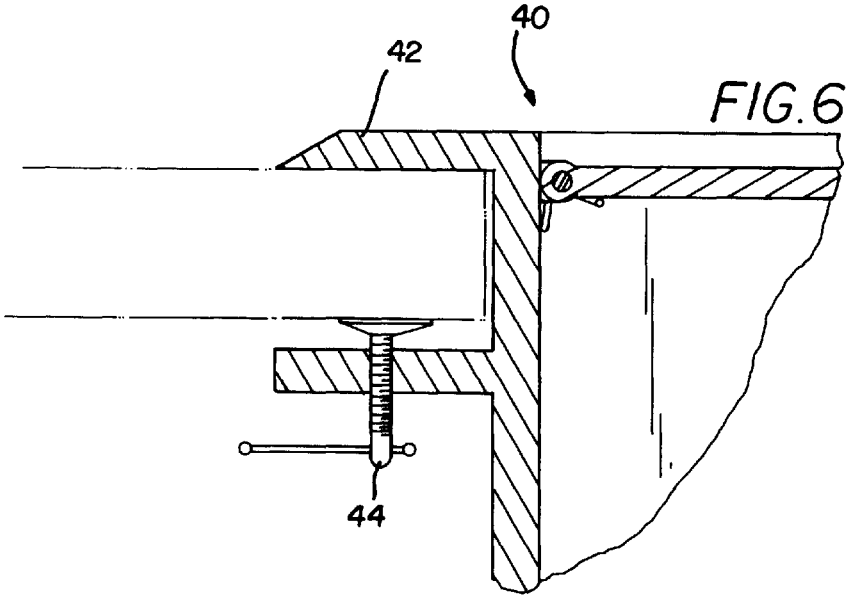
FIG. 6 is a side cross-sectional view of the clamp of the embodiment of the present invention shown in FIGS. 4 & 5.

Next provided is a pair of guides 18 each mounted along the elongated side edges of the first rectangular cut out. As shown in FIG. 3, the guides depend from the table during use. Further, each of the guides preferably has an L-shaped configuration along an entire length thereof.

Figure 2:
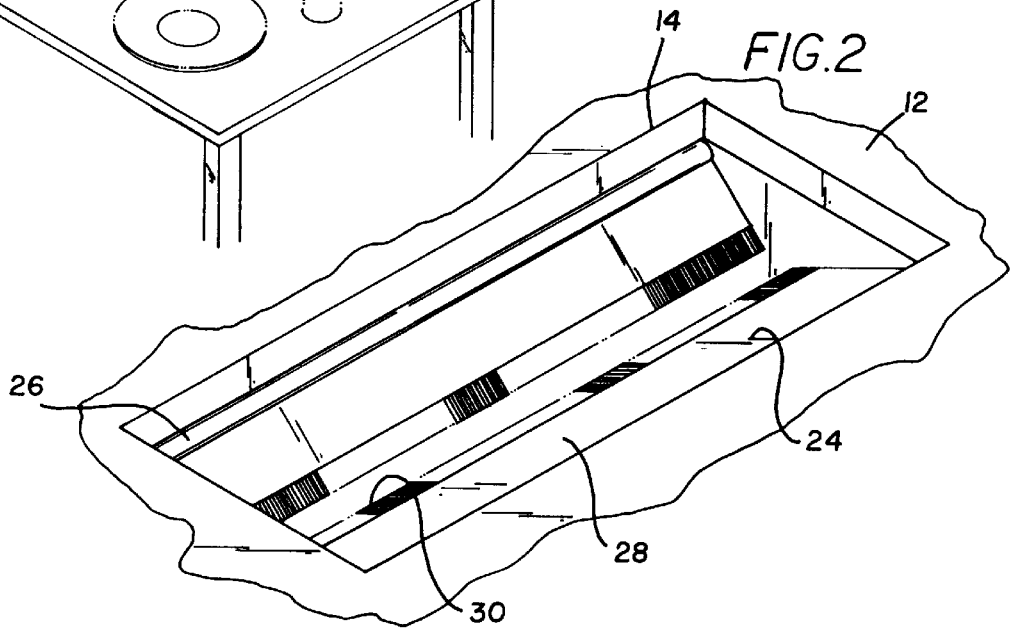
FIG. 2 is a detailed perspective view of the doors of the present invention.

FIG. 3 shows a trash container 20 including a planar rectangular bottom face and a side wall integrally coupled to a periphery of the bottom face and extending upwardly therefrom. By this structure, an interior space, an open top, and an upper peripheral edge is defined. The trash container preferably has a length of 10 inches, a width of 4 inches and a height of 6 inches. The upper peripheral edge has a pair of elongated side edges and a pair of short end edges each having an outwardly extending peripheral lip 22. This lip serves for being slidably received by the guides to align the open top of the container with the first rectangular cut out. Ideally, the open top of the container is level with a lower surface of the table, as shown in FIG. 2.

With reference again to FIG. 2, a pair of doors 24 are shown to each have a planar rectangular configuration with a length equal to that of the first rectangular cut out and a width equal to half that of the first rectangular cut out. The doors have tubular sleeves 26 mounted along inboard edges thereof which hingably receive rods extending between the end edges along opposite side edges of the container. Ideally, the tubular sleeves run along an entire length of the doors. In use, each door may be pivoted between a horizontal orientation and a downwardly angled orientation. In the preferred embodiment, a portion of the sleeve is planar to define a piano hinge that limits the upward rotation doors for reasons that will soon become apparent.

Preferably, each door has an inboard extent 28 constructed from solid plastic and has a width equal to ¼ that of the door. An outboard extent 30 of the door comprises a plurality of resilient nylon bristles coupled to an outboard edge of the inboard extent of the door and extending therefrom in coplanar relationship therewith. The outboard extent of each door has a width equal to ¼ that of the door. Lastly, a spring 31 encompasses each rod and is mounted between the door and the container for urging the doors in a horizontal coplanar relationship. The spring of the present embodiment is similar to that shown in FIG. 4. Ideally, a portion of the sleeve has openings for allowing arms of the spring to extending outwardly and abut the door and container.

Figure 7:
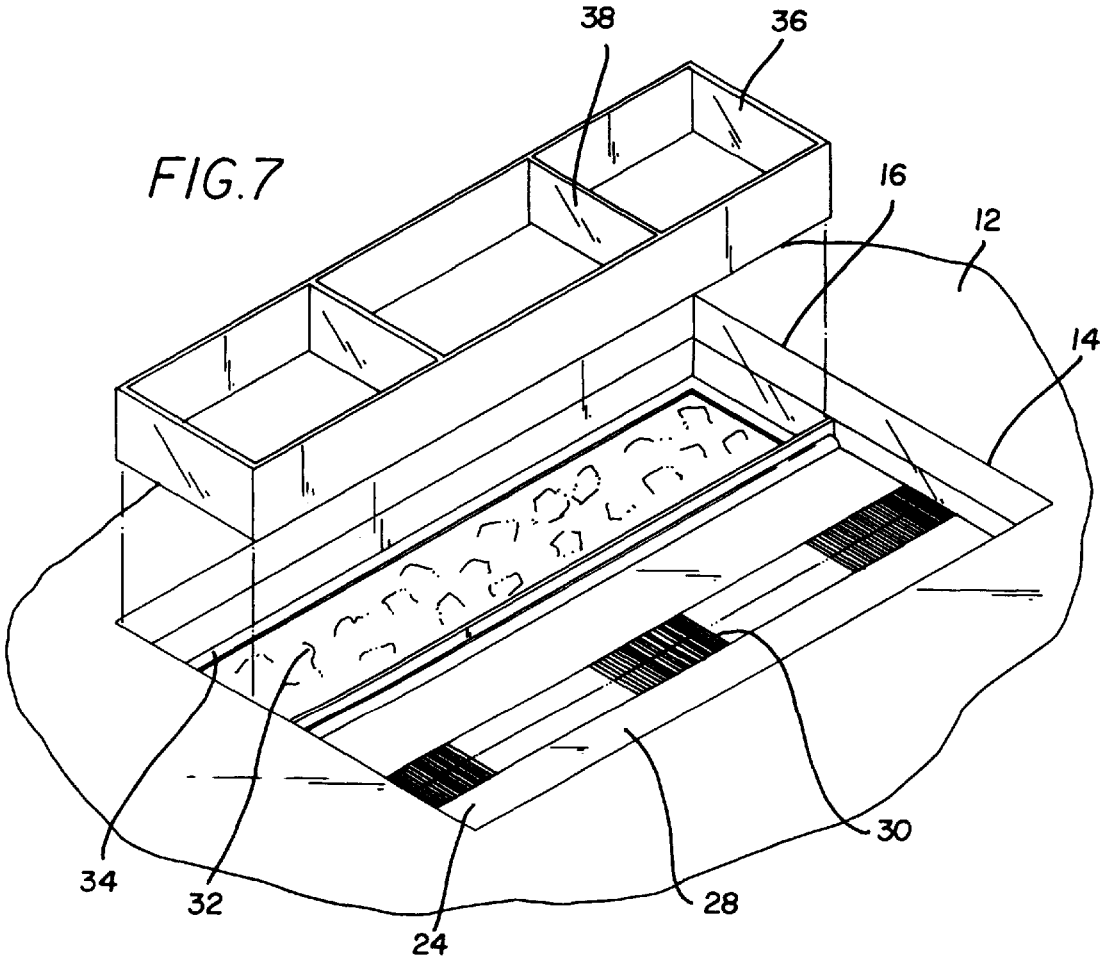
FIG. 7 is a perspective of an optional ice bin of the present invention.

As an option, an ice bin 32 may be included having a planar rectangular bottom face and a side wall similar to that of the trash container. The upper peripheral edge of the ice bin is coupled about a periphery of the second cut out and depends below the table. The ice bin has an inwardly extending peripheral lip 34 which remains level with the lower surface of the table, as shown in FIG. 7. In use, the ice bin serves for being filled with ice level with the inwardly extending lip.

Finally, a removable condiment tray 36 includes a planar rectangular bottom face and a side wall similar to that of the trash container and the ice bin. The removable condiment tray further includes a pair of laterally extending dividers 38 spaced between short end faces of the tray. Each laterally extending divider is equipped with a size and shape equal to that of the end faces of the removable condiment tray. By this structure, the removable condiment tray includes a pair of small end compartments and a large central compartment.

In use, the removable condiment tray is adapted for being removably positioned atop the inwardly extending lip of the ice bin for being cooled by the ice. Further, the removably condiment tray is equipped with a height sufficient to maintain the upper peripheral edge of the removable condiment tray level with an upper surface of the table. In use, condiments of various types may be stored in the compartments of the condiment tray and cooled therein.

In yet another alternate embodiment 40, the upper peripheral lip of the container may be excluded in favor of a pair of rectangular plates 42. Such plates include an upper plate extending from one of the elongated side edges of the container and a lower plate extending from the side wall of the container in spaced parallel relationship with the upper plate. Ideally, an upper outboard edge of the upper plate is beveled and the lower plate has a clamp 44 including an intermediate threaded post, an upper disk rotatably mounted to the threaded post and a lower arm slidably mounted within a diametrically disposed bore formed in the post. By this structure, the container may be clamped to a side edge of the table. Note FIGS. 4–6.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trash disposal system comprising:

a table;

a container being attached to said table and depending therefrom such that an open top of the container is generally level with the table;

a pair of doors pivotally mounted on the container for selectively closing over the open top of the container, the doors being pivotable between a closed orientation and an open orientation, each door having an inboard extent adjacent the container and an outboard extent away from the container, the inboard extent includes a substantially solid panel and the outboard extent includes a plurality of resilient bristles coupled to an outboard edge of the inboard extent, the resilient bristles extending from the inboard extent in a coplanar relationship with the inboard extent, the resilient bristles of one of the doors extending toward and substantially in the same plane as the resilient bristles of the other one of the doors when the doors are in a closed orientation;

a spring member for urging the doors into the closed orientation;

wherein the container is mounted within a cut out formed in the table;

wherein the cut out is lined with guides for slidably receiving a peripheral lip of the container;

wherein an ice bin is positioned adjacent the container for receiving ice therein; and wherein the ice bin has an inwardly extending flange and further included is a removable condiment tray removably positioned atop the flange of the ice of the ice bin.

2. A table mounted trash disposal system comprising, in combination:

a table including a planar top face and a plurality of legs coupled to corners of the top face and extending downwardly therefrom, the table further having a first rectangular cut out formed in the table adjacent to and in parallel with one side edge thereof and a second rectangular cut out formed in the table and positioned in parallel relationship with the first rectangular cut out and having a size and a shape similar to that of the first rectangular cut out, wherein each cut out is defined by a pair of elongated side edges and a pair of short end edges;

a pair of guides each mounted along the elongated side edges of the first rectangular cut out and depending therefrom, each of the guides having an L-shaped configuration along an entire length thereof;

a container including a planar rectangular bottom face and a side wall integrally coupled to a periphery of the bottom face and extending upwardly therefrom to define an interior space, an open top, and an upper peripheral edge defined by a pair of elongated side edges and a pair of short end edges each having an outwardly extending peripheral lip for being slidably received by the guides for aligning the open top of the container with the first rectangular cut out;

a pair of doors each having a planar rectangular configuration with a length equal to that of the first rectangular cut out and a width equal to half that of the first rectangular cut out, the doors having tubular sleeves mounted along inboard edges thereof which hingably receive rods extending between the end edges along opposite side edges of the container such that each door may be pivoted between a horizontal orientation and a downwardly angled orientation, each door having an inboard extent constructed from solid plastic and having a width equal to ¾ that of the door, an outboard extent including a plurality of resilient bristles coupled to an outboard edge of the inboard extent of the door and extending therefrom in coplanar relationship therewith wherein the outboard extent has a width equal to ¼ that of the door, and a spring mounted between the tubular sleeve of the door and the container for urging the doors in a horizontal coplanar relationship;

an ice bin including a planar rectangular bottom face and a side wall integrally coupled to a periphery of the bottom face and extending upwardly therefrom to define an interior space, open top, and an upper peripheral edge coupled about a periphery of the second cut out and depends below the table, the ice bin having an inwardly extending peripheral lip, wherein the ice bin is adapted for being filled with ice level with the inwardly extending lip; and a removable condiment tray including a planar rectangular bottom face and a side wall integrally coupled to a periphery of the bottom face and extending upwardly therefrom to define an interior space, open top, and an upper peripheral edge, the removable condiment tray further including a pair of laterally extending dividers spaced between short end faces of the tray each with a size and shape equal to that of the end faces of the removable condiment tray for defining a pair of small end compartments and a large central compartment, wherein the removable condiment tray is adapted for being removably positioned atop the inwardly extending lip of the ice bin for being cooled by the ice and is equipped with a height sufficient to maintain the upper peripheral edge of the removable condiment tray level with an upper surface of the table.

3. A trash disposal system comprising:

a table including a top face and a plurality of legs coupled to corners of the top face and extending downwardly therefrom, the table further having a first cut out formed in the table and a second cut out, wherein each cut out is defined by a pair of side edges and a pair of end edges;

a pair of guides each mounted along the side edges of the first cut out and depending therefrom, each of the guides having an L-shaped configuration;

a container including a bottom face and a side wall integrally coupled to a periphery of the bottom face and extending upwardly therefrom to define an interior space, an open top, and an upper peripheral edge defined by a pair of side edges and a pair of end edges each having an outwardly extending peripheral lip for being slidably received by the guides for aligning the open top of the container with the first cut out;

a pair of doors each having a length equal to a length of the first cut out and a width equal to half a width of the first cut out, the doors having sleeves mounted along inboard edges thereof which receive hinge rods extending between the end edges along opposite side edges of the container such that each door may be pivoted between a closed orientation and an opened orientation, each door having a substantially solid inboard extent and an outboard extent including a plurality of resilient bristles coupled to an outboard edge of the inboard extent of the door and extending therefrom in coplanar relationship therewith, and a spring mounted between a tubular sleeve of the door and the container for urging the doors into a closed and substantially coplanar orientation;

an ice bin including a bottom face and a side wall integrally coupled to a periphery of the bottom face and extending upwardly therefrom to define an interior space, open top, and an tipper peripheral edge coupled about a periphery of the second cut out and depends below the table, the ice bin having an inwardly extending peripheral lip, wherein the ice bin is adapted for being filled with ice; and a removable condiment tray including a bottom face and a side wall integrally coupled to a periphery of the bottom face and extending upwardly therefrom to define an interior space, open top, and an upper peripheral edge, the removable condiment tray further including a pair of laterally extending dividers spaced between end faces of the tray each with a size and shape equal to that of the end faces of the removable condiment tray for defining a pair of end compartments and a central compartment, wherein the removable condiment tray is adapted for being removably positioned atop the inwardly extending peripheral lip of the ice bin for being cooled by the ice.

* * * * *